US006997734B1

(12) United States Patent
McQuirter

(10) Patent No.: US 6,997,734 B1
(45) Date of Patent: Feb. 14, 2006

(54) ELECTRIC PLUG RETENTION DEVICE

(76) Inventor: Gerald McQuirter, 1020 S. Clarence Ave., Oak Park, IL (US) 60304

( * ) Notice: Subject to any disclaimer, the term of this patent is extended or adjusted under 35 U.S.C. 154(b) by 0 days.

(21) Appl. No.: 10/958,101

(22) Filed: Oct. 4, 2004

(51) Int. Cl.
*H01R 13/62* (2006.01)

(52) U.S. Cl. ..... 439/369

(58) Field of Classification Search ..... 439/369, 439/367; D13/154
See application file for complete search history.

(56) References Cited

U.S. PATENT DOCUMENTS

| | | | | | |
|---|---|---|---|---|---|
| 2,406,567 | A | | 8/1946 | Schuneman | |
| 3,014,194 | A | * | 12/1961 | Berglund | 439/369 |
| 3,048,810 | A | * | 8/1962 | Steen | 439/369 |
| 3,475,716 | A | | 10/1969 | Laig | |
| 4,183,603 | A | * | 1/1980 | Donarummo | 439/369 |
| 4,221,449 | A | | 9/1980 | Shugart, Jr. | |
| 4,773,874 | A | | 9/1988 | Kopeski, Jr. | |
| 4,869,683 | A | * | 9/1989 | Nelson | 439/369 |
| 4,884,979 | A | * | 12/1989 | Budner | 439/369 |
| 5,273,454 | A | * | 12/1993 | Shotey | 439/367 |
| 5,876,234 | A | * | 3/1999 | Hester | 439/369 |
| 6,135,803 | A | | 10/2000 | Kovacik et al. | |
| 6,375,231 | B1 | * | 4/2002 | Picha et al. | 285/114 |
| 6,478,601 | B1 | | 11/2002 | Oswald | |
| D474,156 | S | * | 5/2003 | Vournou | D13/154 |
| D495,999 | S | * | 9/2004 | Lewis | D13/154 |

* cited by examiner

*Primary Examiner*—Neil Abrams
(74) *Attorney, Agent, or Firm*—Philip H. Kier

(57) ABSTRACT

A device for holding the plugs of power tool cords and extension cords in electric contact having a C-shaped collar on each end of a rigid rod. Attached to each collar is a flexible band with complementary strip of separable adhesive material. When power tool cords and extension cords are plugged together and when the cords are placed in the collars, the collars abut the plugs. Wrapping the bands around their respective collars and pressing the adhesive strips together secures the cords in the collars. If a cord is jerked, the plugs will not lose electric contact, rather, the plugs will remain in contact and will move as a unit with this retention device.

2 Claims, 1 Drawing Sheet

ELECTRIC PLUG RETENTION DEVICE

BACKGROUND OF THE INVENTION

This invention relates to a device for keeping the plugs of two electric cords in contact. More particularly, the invention relates to a device that keeps the plugs in electrical contact by means of collars around the cords, the collars abutting the plugs when in electric contact.

Power tools are frequently used some distance from a electric power outlet. Therefore there is frequent use of an extension cord with a male plug of the power tool cord being placed in electric contact with the female plug of an extension cord. Sometimes a second extension cord is needed so that the male plug of the first extension is placed in electrical contact with the female plug of the second extensions. A frequent problem is that the plugs lose electric contact when an extension cord is stretched or jerked. This effect is not only annoying but can also lead to significant loss of productive effort on construction projects.

This problem has long been recognized and various devices for securing power cord plugs and extension cord plugs are found in the patent literature. U.S. Pat. No. 4,221,449 describes a locking device in which the plug is kept in place between two sets of brackets, one set of which is adjustable. U.S. Pat. No. 4,183,603 describes a locking device comprising a U-shaped clip with a hole and a slit. Cords can be forced through the slit into the hole and thereby be held in place. U.S. Pat. No. 3,475,716 describes a retaining devoice having an opening for passage of cord at one end of a flexible band and a flexible fastener at the other end. U.S. Pat. No. 6,478,601 shows a locking device comprising an elongated tube to hold the plugs. The ends of the tube have caps with a slot that can be twisted between open and locking positions.

The present invention is a readily fabricated and easy to use device for keeping power cords and extension cords in electric contact.

SUMMARY OF THE INVENTION

The present invention has a C-shaped collar at each end of rigid strip. The distance between the collars is sufficient for standard plugs of power tools and extension cords to just fit between them when in electric contact. The opening in each collar is sufficient for standard power tool cords and extension cords to fit in the collar. Attached to each collar is a flexible band with complementary separable adhesive strips. The invention is used as follows. The plug of an extension cord and the plug of a power tool, or another extension cord, are pushed together so that they are in electric contact. Then the plugs are placed between the collars and their respective cords are placed within the collars. The cords are kept in the collars by wrapping the flexible bands around the collar and bringing the complementary separable adhesive strips in contact with each other.

BRIEF DESCRIPTION OF THE SEVERAL VIEWS

DETAILED DESCRIPTION OF THE INVENTION

Figure 1:
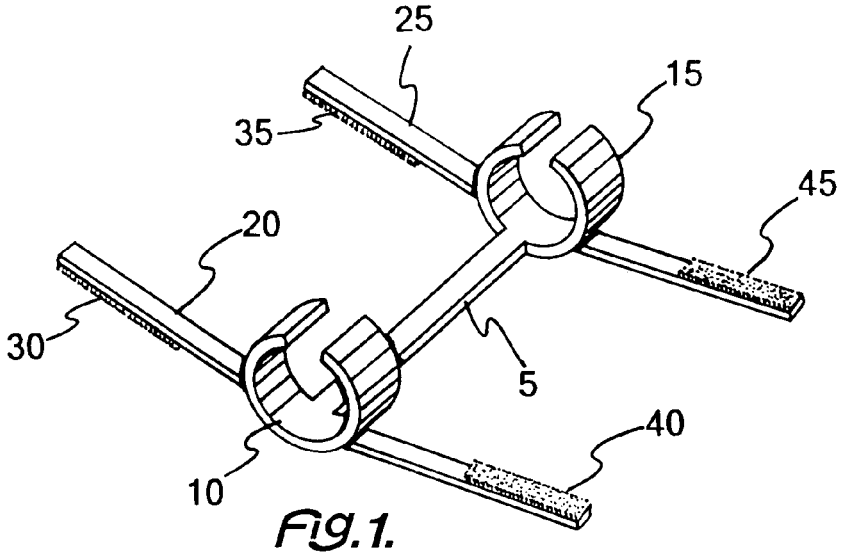
FIG. 1 is a perspective view of the present invention with the flexible bands extended.

With reference to the figures, the present invention has rigid C-shaped collars 10 and 15 integrally attached at each end of a rigid strip 5. If the strip and the collars are plastic, they could be molded together as one piece during manufacture. The collars are spaced such that they will abut the plugs of power tool cords and extension cords when the plugs are in electric contact. The opening of a C-shaped collar is sufficiently large so that a standard extension cord or power tool cord can fit into the opening. A collar is typically one inch (2.54 cm) wide; although it can either wider or narrower than one inch without adversely affecting the performance of the invention. Attached to each collar, opposite from a collar's opening is a flexible band 20 and 25 that is typically made of cloth. The band is usually approximately the same width as the collar. A band has complementary separable adhesive strips, 30 and 40, on band 20, and 35 and 45, on band 25. The adhesive strips are located on a band such that when the band is wrapped around a collar and cover the opening in the collar, the strips will be in adhesive contact. It is preferred that the strips are made of a synthetic material that has the characteristic that the strips will adhere to each other when pressed together but yet can be readily separated when pulled apart. Such a material is sold under the trademark of "VELCRO".

Figure 2:
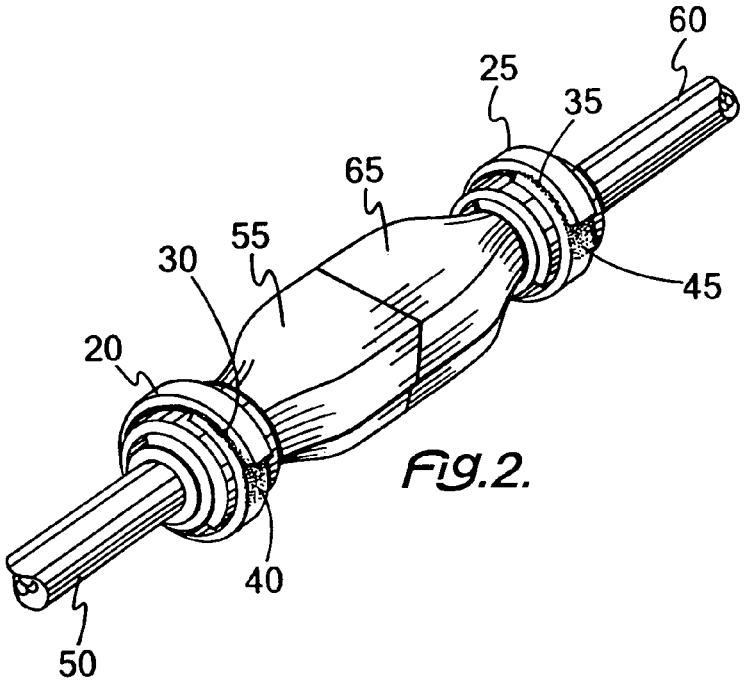
FIG. 2 is a perspective view of the present invention with the collars holding cord and with the flexible bands wrapping around the collars.

FIG. 2 illustrates how the invention can be used. The male plug 55 of an extension cord, or power tool cord, 50 is plugged into the female plug 65 of an extension cord 60. The plugs are then placed on rigid strip 5 and cord 50 is placed within the opening of collar 10 to rest within, and cord 60 is placed within the open of collar 15 to rest within. Then band 20 is wrapped around collar 10 to cover the gap in this collar and adhesive strips 30 and 40 are pressed together so that adhere to each other. Similarly, band 25 is wrapped around collar 15 to cover the gap in this collar and adhesive strips 35 and 45 are pressed together so that adhere to each other. A collar is sized such that a plug cannot fit within it. After the cords are secured within the collars as described, the plugs will not be dislodged should one of the cords be jerked. With the cords secured in the collars by the bands, movement of the plugs is restrained by the collars, and the invention and plugs will move together, rather than the plugs moving relative to each other and losing electric contact when a cord is jerked. When a user is finished using the power tool, the adhesive strips are separated, the band are unwrapped, and the cords are removed from the collars.

I claim:

1. A device for retaining plugs of electric cord in electric contact comprising:

a rigid strip with two ends;

a C-shaped collar with an opening that can accommodate an electric cord integrally attached to each end of the rigid strip, the collars being spaced to abut plugs of the cords when the plugs are in electric contact and being sized so that they do not accommodate the plugs;

a flexible band attached to each collar, the flexible band being long enough to cover the opening in a collar when wrapped around the collar; and complementary strips of separable adhesive material on opposite ends of a flexible band, the strips of the separable adhesive material being oriented such that they will be in contact when the flexible band is wrapped around the collar.

2. A device as set forth in claim 1 wherein the collars and the rigid strip are made of plastic and molded together as one piece.

* * * * *